US010781657B2

(12) United States Patent
Hardt et al.

(10) Patent No.: US 10,781,657 B2
(45) Date of Patent: Sep. 22, 2020

(54) INTELLIGENT RCD SYSTEM

(71) Applicant: Schlumberger Technology Corporation, Sugar Land, TX (US)

(72) Inventors: Jesse Alan Hardt, Houston, TX (US); Zaurayze Tarique, Houston, TX (US); Yawan Couturier, Katy, TX (US); Blaine Dow, Sugar Land, TX (US); Walter Benson, Houston, TX (US); Charles H Kamps, III, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 226 days.

(21) Appl. No.: 15/753,546

(22) PCT Filed: Aug. 22, 2016

(86) PCT No.: PCT/US2016/047939
§ 371 (c)(1),
(2) Date: Feb. 19, 2018

(87) PCT Pub. No.: WO2017/035041
PCT Pub. Date: Mar. 2, 2017

(65) Prior Publication Data

US 2018/0245444 A1 Aug. 30, 2018

Related U.S. Application Data

(60) Provisional application No. 62/208,379, filed on Aug. 21, 2015, provisional application No. 62/213,451, filed on Sep. 2, 2015.

(51) Int. Cl.
*E21B 33/08* (2006.01)
*E21B 44/00* (2006.01)
(Continued)

(52) U.S. Cl.
CPC ..... *E21B 33/085* (2013.01); *E21B 44/00* (2013.01); *E21B 3/02* (2013.01); *E21B 3/04* (2013.01)

(58) Field of Classification Search
CPC . E21B 3/02; E21B 3/04; E21B 33/085; E21B 44/00
See application file for complete search history.

(56) References Cited

U.S. PATENT DOCUMENTS 5,022,472 A 6/1991 Bailey et al.
6,354,385 B1 3/2002 Ford et al.
(Continued)

FOREIGN PATENT DOCUMENTS

WO 2010/006217 A1 1/2010
WO 2014/105077 A2 7/2014
WO 2014/105305 A1 7/2014

OTHER PUBLICATIONS

International Preliminary Report on Patentability for the equivalent International patent application PCT/US2016/047939 dated Mar. 8, 2018.

(Continued)

*Primary Examiner* — Tara E Schimpf
(74) *Attorney, Agent, or Firm* — Jeffrey D. Frantz

(57) ABSTRACT

A method includes receiving a plurality of signals from a plurality of sensors into a programmable logic controller, the plurality of sensors provided on at least one component of a rotating control device assembly of a drilling system, providing measurement data from the plurality of signals using the programmable logic controller, and processing the measurement data using a modeling software to determine at least one condition of the rotating control device assembly.

20 Claims, 6 Drawing Sheets

(51) Int. Cl.
*E21B 3/02* (2006.01)
*E21B 3/04* (2006.01)

(56) References Cited

U.S. PATENT DOCUMENTS

| | | | | |
|---|---|---|---|---|
| 2008/0060846 | A1 | 3/2008 | Belcher et al. | |
| 2012/0186873 | A1 | 7/2012 | Shayegi et al. | |
| 2012/0285744 | A1* | 11/2012 | Bernard | E21B 21/08 175/57 |

OTHER PUBLICATIONS

Office Action for the equivalent Canadian patent application 2996176 dated Dec. 11, 2018.
International Search Report and Written Opinion for the equivalent International patent application PCT/US2016/047939 dated Nov. 22, 2016.
Examination Report for the counterpart Canadian patent application 2996176 dated Dec. 10, 2019.

* cited by examiner

INTELLIGENT RCD SYSTEM

BACKGROUND

During downhole drilling operations, an earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

Typically, drilling mud is delivered to the drill bit from the surface under high pressure through a central bore of the drillstring. From there, nozzles on the drill bit direct the pressurized mud to the cutters on the drill bit where the pressurized mud cleans and cools the bit. As the fluid is delivered downhole through the central bore of the drillstring, the fluid returns to the surface in an annulus formed between the outside of the drillstring and the inner profile or wall of the drilled wellbore. Drilling mud returning to the surface through the annulus does so at lower pressures and velocities than it is delivered. Nonetheless, a hydrostatic column of drilling mud typically extends from the bottom of the hole up to a bell nipple of a diverter assembly on the drilling rig. Annular fluids exit the bell nipple where solids are removed, the mud is processed, and then prepared to be re-delivered to the subterranean wellbore through the drillstring.

As wellbores are drilled several thousand feet below the surface, the hydrostatic column of drilling mud in the annulus serves to help prevent blowout of the wellbore, as well. Often, hydrocarbons and other fluids trapped in subterranean formations exist under significant pressures. Absent any flow control schemes, fluids from such ruptured formations may blow out of the wellbore and spew hydrocarbons and other undesirable fluids (e.g., $H_2S$ gas).

Thus, rotating control devices ("RCD") are frequently used in oilfield drilling operations where elevated annular pressures are present to seal around drill string components and prevent fluids in the wellbore from escaping. For example, conventional RCDs may be capable of isolating pressures in excess of 1,000 psi while rotating (i.e., dynamic) and 2,000 psi when not rotating (i.e., static). However, conventional RCDs may be designed to isolate other ranges of pressures, depending on the formations being drilled and type of drilling operations being conducted. A RCD may include a packing or sealing element and a bearing package, whereby the bearing package allows the sealing element to rotate along with the drillstring. Therefore, in using a RCD, there is no relative rotational movement between the sealing element and the drillstring, only the bearing package exhibits relative rotational movement. Examples of RCDs include U.S. Pat. Nos. 5,022,472 and 6,354,385. In some instances, dual stripper rotating control devices having two sealing elements, one of which is a primary seal and the other a backup seal, may be used.

DETAILED DESCRIPTION

Downhole drilling operations, including managed pressure drilling (MPD) and under balanced drilling operations through subsurface formations may include the use of an assembly known as a rotating control head or rotating control device (RCD). A rotating flow head is an apparatus for well operations which diverts fluids such as drilling mud, surface injected air or gas and other produced wellbore fluids, into a recirculating or pressure recovery "mud" (drilling fluid) system. The RCD includes a bearing package and seal assembly that enables rotation of a drill string and longitudinal motion of a drill string as the wellbore is drilled, while maintaining a fluid-tight seal between the drill string and the wellbore so that drilling fluid discharged from the wellbore may be discharged in a controlled manner. By controlling discharge of the fluid from the wellbore, a selected fluid pressure may be maintained in the annular space between the drill string and an exterior of the wellbore. Control of the discharge may be performed manually or automatically, such as by using a choke to restrictively allow fluid flow through a return flow line.

Figure 1:
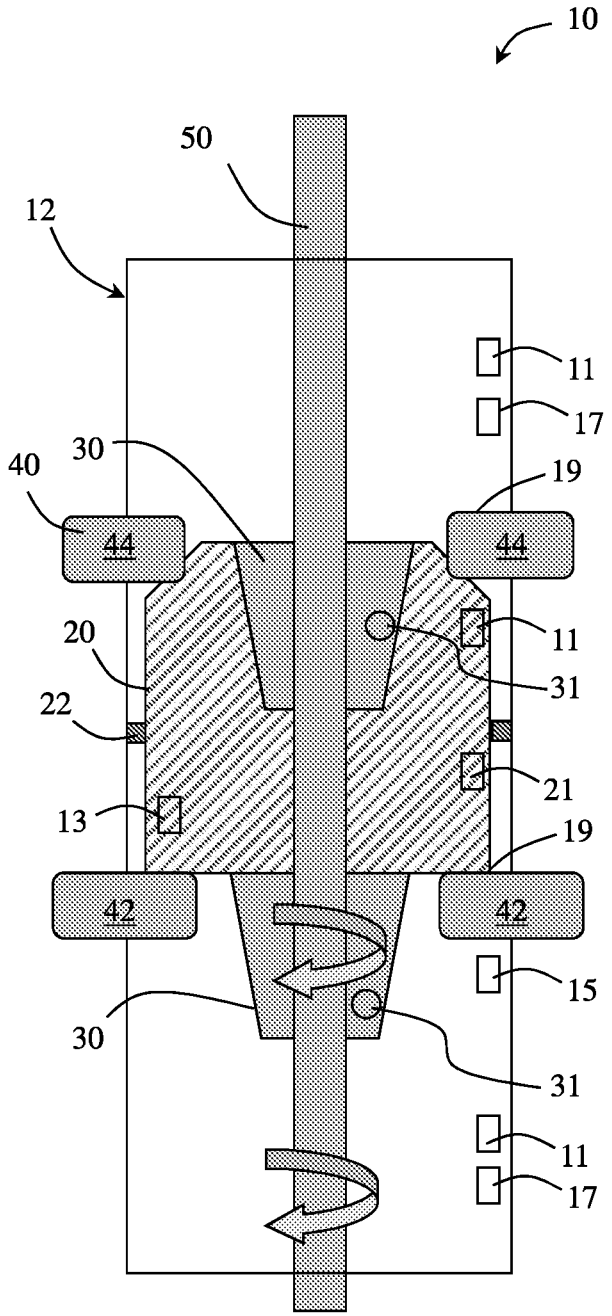
FIG. 1 is a cross-sectional diagram of an RCD assembly according to embodiments of the present disclosure.

FIG. 1 shows a diagram of an example of an RCD assembly 10 according to embodiments of the present disclosure. The RCD assembly 10 is disposed around a drill string 50 and includes a bearing package 20, at least one sealing component 30, latching components 40, and an RCD housing 12. The sealing components 30 may be referred to as sealing elements or packers. As shown, in some embodiments, there may be an upper sealing element 30 and a lower sealing element 30 disposed around the drill string 50. A bearing outer seal 22 may be disposed between the bearing package 20 and the RCD housing 12. The latching components 40 may include landing pistons 42 and latching pistons 44. However, other types of latching components may be used to hold an RCD assembly in place within a wellbore casing or riser (not shown). The sealing elements 30 grip around the drill string 50 such that the RCD assembly 10 rotates with the drill string 50. Drill string slip (when the drill string rotates at a different rate than the RCD assembly) may indicate wear or failure of one or more components in the RCD assembly, e.g., fatigue of a sealing element or contaminants in the bearing package.

A plurality of sensors may be disposed along the RCD assembly 10 to monitor performance of various components within the RCD assembly 10. Sensor types may include, for example, frequency sensors, temperature sensors, position sensors, pressure sensors, and vibration sensors. For example, as shown, one or more types of pressure sensors 11 may be disposed on the RCD housing 12 above and below the bearing package 20 and disposed within the bearing package 20 between the upper and lower sealing elements 30. The pressure sensors may be used to monitor the pressure of the areas in which they are disposed, which may be used, for example, to analyze and/or predict the condition of the components of the RCD assembly 10. For example, a pressure sensor located on the RCD housing above the bearing package 20 may be used to measure hydraulic pressure in the well, and a pressure sensor located on the RCD housing below the bearing package 20 may be used to measure annular pressure of the well. In some embodiments, pressure sensors may be disposed within an RCD assembly and within the wellbore, where the pressure within the RCD assembly may be compared to the pressure in the wellbore. Relative pressure changes between the RCD assembly and the wellbore may indicate, for example, wear or failure of one or more components of the RCD assembly.

Pressure sensor types may include various types of devices known in the art that generate a signal as a function of the pressure imposed on the device. For example, pressure sensors types may include, but are not limited to capacitive pressure sensors, electromagnetic pressure sensors, piezoelectrics, optical pressure sensors, and potentiometric sensors. Other types of pressure sensors may include pressure indication assemblies having one or more pressure relief valves, one or more pistons, and one or more associated proximity switches, each piston assembled radially between a pressure relief valve and a proximity switch, where upon reaching a pressure greater than a preset pressure value of the pressure relief valve, the pressure relief valve opens and pushes the piston toward the proximity switch. The proximity switch may then send a signal indicating the proximity of the piston, which indicates a pressure greater than the preset pressure value of the pressure relief valve.

The bearing package 20 may include one or more internal pressure sensors 11 and temperature sensors 21. Suitable temperature sensor types may include but are not limited to thermistors, thermocouples, bimetal sensors, infrared thermometers, and other thermometer types known in the art. Further, temperature sensors may be disposed on other components of the RCD assembly 10. For example, temperature sensor 15 may be disposed on the RCD housing 10 below the bearing package 20 to measure the wellbore temperature. In some embodiments, temperature sensors may be disposed within an RCD assembly and within a wellbore to monitor relative changes in temperature between the fluid temperature in the wellbore and the fluid temperature within the RCD assembly. Changes in the temperature difference between the temperature measured in an RCD assembly and in the wellbore may indicate, for example, wear or failure of one or more components in the RCD assembly.

A seal wear detection sensor 31 may be disposed on the sealing components 30 for monitoring wear of the sealing components 30. For example, seal wear detection sensor types may include but are not limited to Eddy-current sensors or ultrasonic sensors for detecting changes in material properties of the seals, which may indicate wear of the seal.

Frequency sensors 13 may be disposed on the bearing package 20, for example on the bearing package outer housing, to measure the rotational speed of the bearing package and/or rotational speed of the drill string 50. Suitable frequency sensors may include but are not limited to optical sensors, magnetic sensors, and other sensor types known in the art that are capable of measuring rotational speed. In embodiments monitoring the rotational speed of the bearing package 20 and the drill string 50, the rotational speeds may be compared to determine if there is a mismatch in rotational speed, which may indicate slip. In some embodiments, one or more frequency sensors 13 may be used to monitor the rotational speed of the bearing package 20 and/or sealing component 30, which may be compared with the inputted rotational speed of the drill string (e.g., the rotational speed of the drill string set by the operator at the platform or rig) to determine if there is a mismatch in rotational speed.

Vibration sensors 17 may be disposed on the RCD housing 12 to monitor the movement of the RCD assembly 10. For example, when an RCD assembly is assembled along a riser (not shown), movement of the riser from drilling operations and heaves from the surrounding body of water may result in forces applied to the RCD assembly, which may fatigue different components of the RCD assembly. In some embodiments, one or more vibration sensors may be disposed on a bearing package of an RCD assembly, where the vibration sensors may detect vibrations in the bearing package. Suitable vibration sensors may include but are not limited to piezoelectric sensors, accelerometers, and other sensor types known to be capable of detecting vibration.

Further, in some embodiments, an RCD assembly 10 may include at least one position sensor 19 disposed on or near a latching component to monitor the position of the latching component. In some embodiments, at least one position sensor 19 may be disposed on a bearing package in a location that engages or is proximate to a latching component when it is in the latched position. Position sensors 19 may include but are not limited to magnetic sensors, capacitive transducers, Eddy-current sensors, piezoelectric transducers, inductive sensors, Hall effect sensors, and other sensors known in the art capable of measuring an absolute position or a relative position (such as by using displacement sensors).

Figure 2:
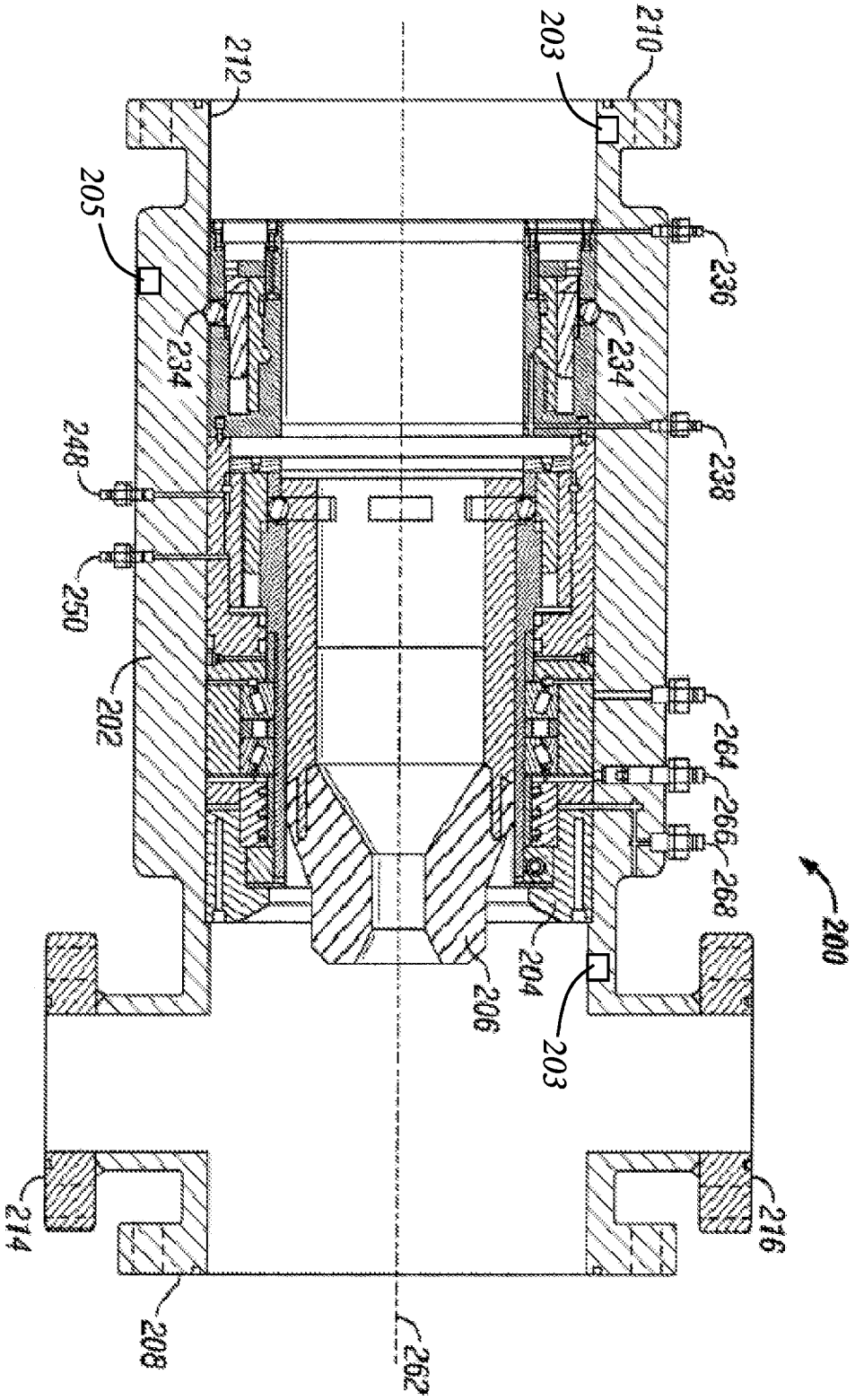
FIG. 2 is a cross-sectional drawing of an RCD assembly according to embodiments of the present disclosure.
Figure 3:
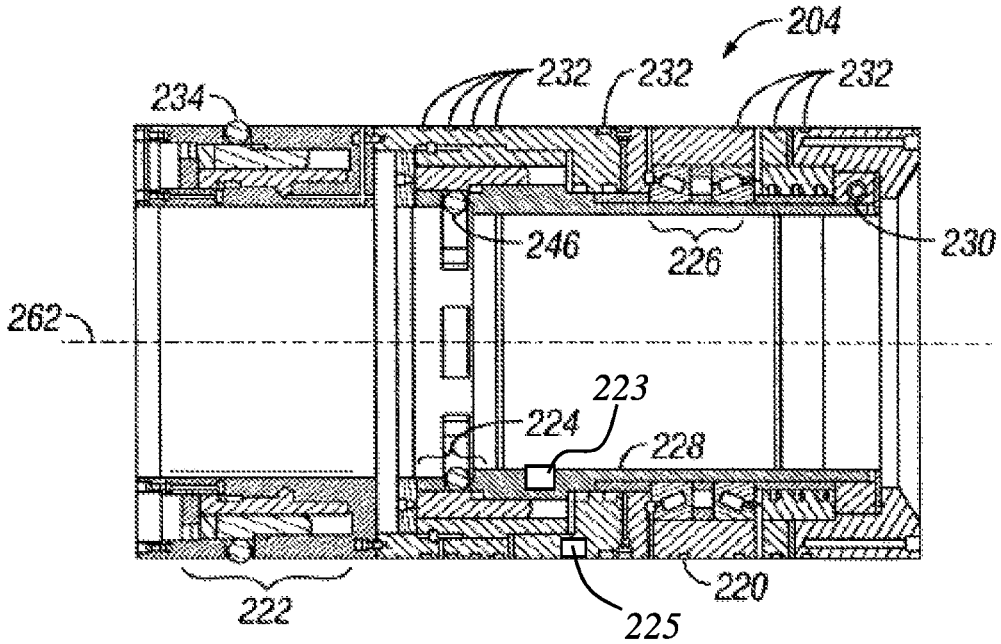
FIG. 3 is a cross-sectional drawing of a bearing package of the RCD assembly of FIG. 2.
Figure 4:
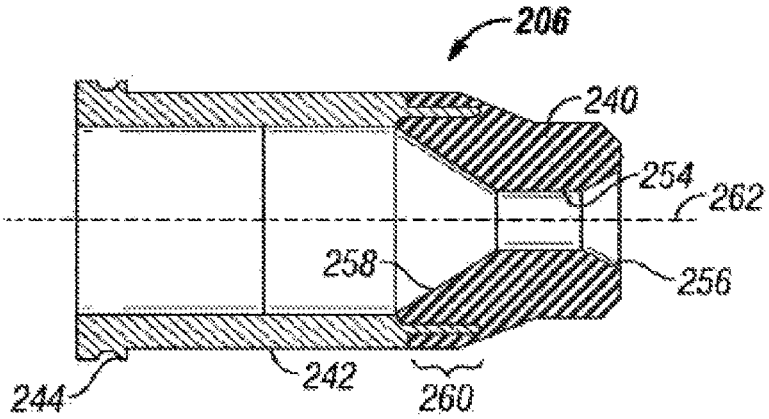
FIG. 4 is a cross-sectional drawing of a sealing component of the RCD assembly of FIG. 2.

Referring now to FIGS. 2-4, a more detailed example of an RCD assembly is provided. FIG. 2 shows an RCD assembly 200 in an assembled state. The RCD 200 is composed of a housing 202, a bearing package 204, and a sealing component 206. The housing 202 includes a lower connection 208 and an upper connection 210, for example flange connections, to the remainder of a riser assembly (e.g., a slip joint), an inner bore 212, and a pair of outlet flanges 214, 216. One or more compartments or recesses 203 may be formed along the wall of the inner bore 212, which may hold one or more sensors (not shown). For example, recesses 203 may have temperature sensors or pressure sensors disposed therein for monitoring the temperature and/or pressure of the medium within the inner bore 212. In some embodiments, sensors may be disposed along the wall of the inner bore 212. Further, one or more compartments or recesses 205 may be formed along the outer wall of the housing 202, which may hold one or more sensors. For example, recesses 205 may have vibration sensors disposed therein for monitoring the amount of vibration the RCD assembly is being subjected to during operation. In some embodiments, sensors may be disposed on the outer wall of the housing 202 (as opposed to being disposed within a recess formed in the outer wall). In some embodiments, sensors may be positioned along two or more points on the RCD housing 202 to measure pitch and roll of the RCD assembly 200. Suitable pitch and roll sensors may include, for example, pitch and roll sensors utilizing micro electromechanical systems, such as Microtilt sensors, attitude sensors, or other pitch and roll sensors utilizing accelerometers oriented in the x, y, and z orientations.

Outlet flanges 214, 216 may be used to connect the RCD assembly 200 to one or more fluid diverting conduits, but one of ordinary skill in the art will understand that the outlet flanges 214, 216 are not necessary to the functionality of the RCD assembly 200. Particularly, outlet flanges 214, 216 may be relocated to other components of the riser assembly if desired. Furthermore, flange connections 208 and 210 may be of any particular type and configuration, but should be selected such that the RCD assembly 200 may sealingly mate with adjacent components of the riser assembly.

Referring now to FIGS. 2 and 3 together, bearing package 204 is engaged within bore 212 of RCD 200. As shown, bearing package 204 includes an outer housing 220, a first locking assembly 222 to hold bearing package 204 within housing 202 of RCD 200, and a second locking assembly 224 to hold the sealing component 206 within the bearing package 204. Furthermore, bearing package 204 includes a bearing assembly 226 to allow an inner sleeve 228 to rotate with respect to outer housing 220 and a seal 230 to isolate bearing assembly 226 from wellbore fluids. A plurality of seals 232 are positioned about the periphery of outer housing 220 so that bearing package 204 may sealingly engage inner bore 212 of housing 202. While seals 232 are shown to be O-ring seals about the outer periphery of bearing package 204, one of ordinary skill in the art will appreciate than any type of seal may be used. One or more compartments or recesses 223 may be formed within the inner sleeve 228 to hold one or more sensors. For example, a frequency sensor, temperature sensor and/or pressure sensor may each be disposed within a recess 223 to measure and monitor selected conditions within the bearing package 204. In some embodiments, one or more sensors (not shown) may be disposed on the inner surface of the inner sleeve 228 (as opposed to within a recess formed in the inner surface). Further, one or more recesses 225 may be formed within the outer wall of the outer housing 220 to hold one or more sensors. For example, a pressure sensor (not shown) may be disposed within a recess 225 to monitor the pressure between the bearing package 204 and the housing 202 of the RCD assembly 200, which may indicate whether any failure in the seals 232 have occurred. In some embodiments, vibration sensors (not shown) may be disposed in recesses 223 formed in the inner sleeve 228 and/or in recesses 225 formed in the outer housing 220 to measure vibration of the bearing package 204.

The first locking assembly 222 may be hydraulically actuated such that a plurality of locking lugs 234 are moved radially outward and into engagement with a corresponding groove within inner bore 212 of housing 202. As shown in the assembled state in FIG. 2, two hydraulic ports, a clamp port 236 and an unclamp port 238, act through housing 202 to selectively engage and disengage locking lugs 234 into and from the groove of inner bore 212. One of ordinary skill in the art will understand that any clamping mechanism may be used to retain bearing package 204 within housing 202 without departing from the scope of the claimed subject matter. Particularly, various mechanisms including, but not limited to, electromechanical, hydraulic, pneumatic, and electromagnetic mechanisms may be used for first and second locking assemblies 222, 224. Furthermore, as should be understood by one of ordinary skill in the art, bearing assembly 226 may be of any type of bearing assembly capable of supporting rotational and thrust loads. As shown in FIGS. 2 and 3, bearing assembly 226 is a roller bearing comprising two sets of tapered rollers. Alternatively, ball bearings, journal bearings, tilt-pad bearings, and/or diamond bearings may be used with bearing package 204 without departing from the scope of the claimed subject matter.

Referring now to FIGS. 2, 3 and 4 together, sealing component 206 is engaged within bearing package 204. As shown, the sealing component 206 includes a stripper rubber 240 and a housing 242. While a single stripper rubber 240 is shown, one of ordinary skill would understand that more than one stripper rubber 240 may be used. Housing 242 may be made of high-strength steel and include a locking profile 244 at its distal end that is configured to receive a plurality of locking lugs 246 from second locking assembly 224 of bearing package 204. Second locking assembly 224 retains packing element 206 within bearing package 204 (which, in turn, is locked within housing 202 by first locking assembly 222) when pressure is applied to a second hydraulic clamping port 248. Similarly, when packing element 206 is to be retrieved from bearing assembly 204, pressure may be applied to second hydraulic unclamping port 250 to release locking lugs 246 from locking profile 244. Further, hydraulic lubricant may flow through ports 264, 266 and 268 to communicate with and lubricate bearing assembly 226.

Referring now to FIG. 4, the stripper rubber 240 is constructed so that threaded tool joints of a drill string (not shown) may be passed therethrough. As such, stripper rubber 240 includes a through bore 254 that is selected to sealingly engage the size of drill pipe (not shown) that is to be engaged through RCD assembly 200. Further, to accommodate the passage of larger diameter tool joints therethrough during a drill string tripping operation, stripper rubber 240 may include tapered portions 256 and 258. Furthermore, stripper rubber 240 may include upset portions 260 on its outer periphery to effectively seal stripper rubber 240 with inner sleeve 228 of bearing package 204, such that high pressure fluids may not bypass packing element 206.

As assembled, stripper rubber 240 seals around the drill string and prevents high-pressure fluids from passing between sealing component 206 and bearing package 204. Seal 230 of the bearing package 204 prevents high-pressure fluids from invading and passing through bearing assembly 226, and seals 232 prevent high-pressure fluids from passing between housing 202 and bearing package 204. Therefore, when packing element 206 is installed within bearing package 204 which is, in turn, installed within housing 202, a drill string may engage through RCD 200 along a central axis 262 such that high-pressure annular fluids between the outer profile of the drill string and the inner bore of riser string are isolated from upper riser assembly components. One or more pressure sensors (not shown) may be disposed along the bearing package 204, for example on the outer housing 220 or proximate the bearing assembly 226, to monitor increases in pressure, which may indicate that one or more of the seals 230, 232 have failed.

According to some embodiments, a proximity sensor may be positioned in a bearing package 204, for example, in a sensor pocket formed in a wall of the bearing package similar to the recesses 223, 225 shown in FIG. 3, to measure the position of a compensating piston, which may indicate the level of lubricant (e.g., oil) in an accumulator. For example, one or more accumulators may be disposed in an outer housing of a bearing package, each accumulator having an accumulator piston and spring disposed therein and a lubricant supplied through an accumulator lubricant port to the bearing package. The springs may supply the force to keep the bearing pressure above the wellbore pressure, and the pistons may move therein as temperature changes affect the lubricant volume. A proximity sensor may be positioned to detect the position of each piston, thereby indicating the volume of lubricant in the accumulator. For example, as a piston moves vertically lower in an accumulator, the piston could contact or be detected by a switch to indicate that the lubricant level was low. A suitable proximity sensor may include, for example, a limit switch, Hall Effect device or linear potentiometer.

In some embodiments, a bearing package may include a contamination sensor, which may be positioned in a sensor pocket formed in a wall of the bearing package, such as in a recess similar to recesses 223, 225 shown in FIG. 3. A contamination sensor may be used to indicate contamination in the lubrication system of a bearing package. Suitable contamination sensors may include, for example, a switch or other indicator of fluid resistivity. For example, a contamination sensor may measure a base resistivity of lubricant in a bearing package, a relatively higher resistivity measurement may indicate purer lubricant (e.g., when new lubricant is supplied), and a relatively lower resistivity measurement may indicate water and/or other contamination in the lubricant.

Sensors as described herein may be in wireless communication with or may be wired to a programmable logic controller, depending on, for example, the types of sensors being used, the location of the sensor on the RCD assembly, and the location of the RCD assembly, where the programmable logic controller may receive signals from the sensors and mediate data transmission to a computational device. The programmable logic controller may continuously monitor the state of the sensors and transmit data to the computational device. For example, a programmable logic controller may provide real-time feedback of pressure, temperature, frequency, position and/or other measurements provided from the sensor signals.

According to embodiments of the present disclosure, a drilling system may include a rotating control device assembly disposed around a drill string, a plurality of sensors disposed along the rotating control device assembly, a programmable logic controller in communication with the plurality of sensors, a computational device having a modeling software, and a data store storing measurement data processed by the programmable logic controller from signals received from the plurality of sensors, where the data store is in communication with the computational device. Drilling systems of the present disclosure utilizing an RCD may include onshore or offshore drilling systems. For example, FIG. 5 shows an example of an offshore drilling system, and FIG. 6 shows an example of an onshore drilling system.

Figure 5:
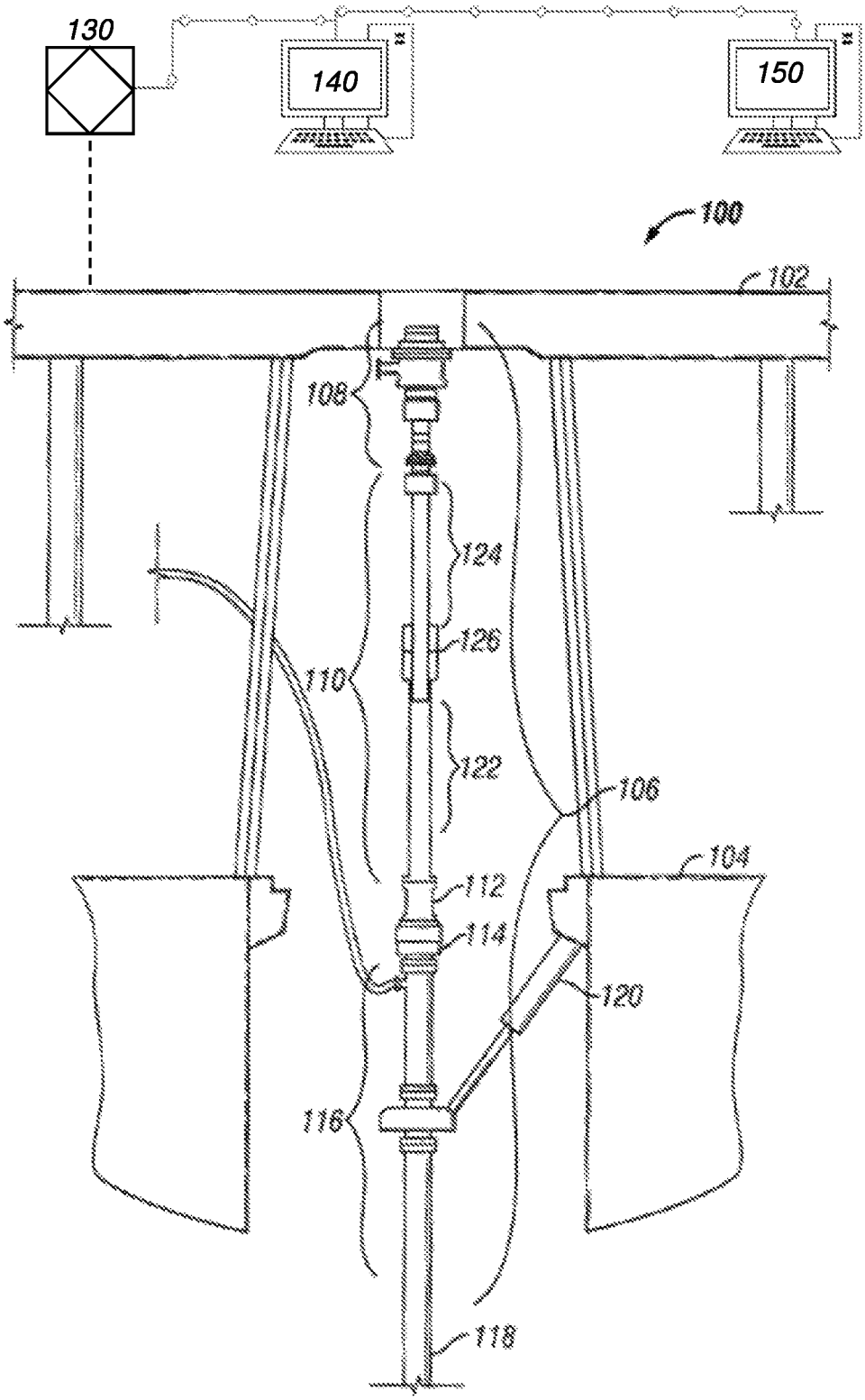
FIG. 5 shows a system according to embodiments of the present disclosure.
Figure 6:
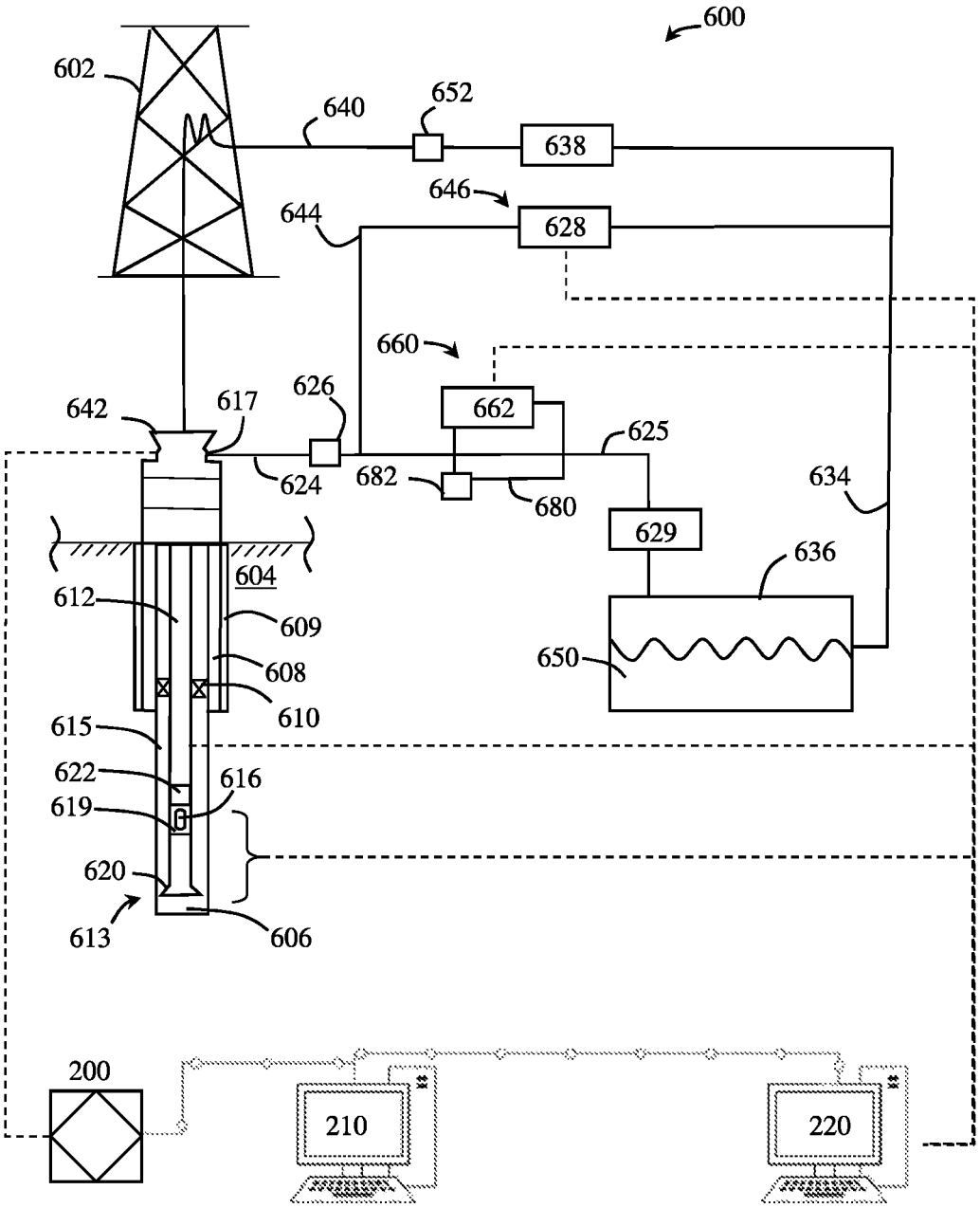
FIG. 6 shows a system in accordance with embodiments of the present disclosure.

Referring to FIG. 5, a drilling system according to embodiments of the present disclosure is shown. The drilling system includes an offshore drilling platform 100 having a rig floor 102 and a lower bay 104. While offshore drilling platform 100 is depicted as a semi-submersible drilling platform, one of ordinary skill will appreciate that a platform of any type may be used including, but not limited to, drillships, spar platforms, tension leg platforms, and jack-up platforms. A riser assembly 106 extends from a subsea wellhead (not shown) to offshore drilling platform 100 and includes various drilling and pressure control components.

From top to bottom, riser assembly 106 includes a diverter assembly 108 (shown including a standpipe and a bell nipple), a slip joint 110, a RCD 112, an annular blowout preventer 114, a riser hanger and swivel assembly 116, and a string of riser pipe 118 extending to subsea wellhead (not shown). While one configuration of riser assembly 106 is shown and described in FIG. 5, one of ordinary skill in the art should understand that various types and configurations of riser assembly 106 may be used in conjunction with embodiments of the present disclosure. Specifically, it should be understood that a particular configuration of riser assembly 106 used will depend on the configuration of the subsea wellhead below, the type of offshore drilling platform 100 used, and the location of the well site.

Offshore drilling platform 100 may have significant relative axial movement (i.e., heave) between its structure (e.g., rig floor 102 and/or lower bay 104) and the sea floor. Therefore, a heave compensation mechanism (not shown) may be employed so that tension may be maintained in riser assembly 106 without breaking or overstressing sections of riser pipe 118. As such, slip joint 110 may be constructed to allow 30 ft., 40 ft., or more stroke (i.e., relative displacement) to compensate for wave action experienced by drilling platform 100. Furthermore, a hydraulic member 120 is shown connected between rig floor 102 and hanger and swivel assembly 116 to provide upward tensile force to a string of riser pipe 118 as well as to limit a maximum stroke of slip joint 110. To counteract translational movement (in addition to heave) of drilling platform 100, an arrangement of mooring line (not shown) may be used to retain drilling platform 100 in a substantially constant longitudinal and latitudinal area.

As shown, slip joint 110 is constructed as a three-piece slip joint having a lower section 122, an upper section 124, and a seal housing 126. In operation, upper section 124 plunges into lower section 122 similar to a piston into a bore while seal housing 126 maintains a fluid seal between two sections 122, 124. Thus, riser assembly 106 may be constructed such that diverter assembly 108 may be rigidly affixed relative to rig floor 100 and with riser string 118 rigidly affixed to the subsea wellhead below. Therefore, the heave and movement of drilling platform 100 relative to the subsea wellhead may be taken up by slip joint 110 and hydraulic member 120.

In certain operations including, but not limited to MPD operations, riser assembly 106 may be required to handle high annular pressures. However, components such as diverter assembly 108 and slip joint 110 may not be constructed to handle the elevated annular fluid pressures associated with managed pressure drilling. In such embodiments, components in an upper portion of riser assembly 106 may be isolated from the elevated annular pressures experienced by components located in a lower portion of riser assembly 106. For example, as shown, RCD 112 may be included in riser assembly 106 between riser string 118 and slip joint 110 to rotatably seal about a drillstring (not shown) and prevent high pressure annular fluids in riser string 118 from reaching slip joint 110, diverter assembly 108, and the environment.

The RCD 112 may be capable of isolating pressures in excess of 1,000 psi while rotating (i.e., dynamic) and 2,000 psi when not rotating (i.e., static) from upper portions of riser assembly 106. While annular blowout preventer 114 may be capable of similarly isolating annular pressure, such annular blowout preventers are not intended to be used when the drill string is rotating, as would occur during an MPD operation.

A plurality of sensors, such as described in FIGS. 1-4, is disposed along one or more components of the RCD 112 and is in communication with a programmable logic controller 130. The sensors may send signals wirelessly to the programmable logic controller 130 (e.g., by sending signals to a receiver within the programmable logic controller) or may be wired to the programmable logic controller 130. The programmable logic controller 130 may process the signals received from the sensors and provide measurement data to a computational device 140 having modeling software thereon. Using the measurement data, modeling software on the computational device may model, monitor, and/or analyze performance of one or more components of the RCD 112.

Computational devices may include one or more computer processor(s), associated memory (e.g., random access memory (RAM), cache memory, flash memory, etc.), one or more storage device(s) (e.g., a hard disk, an optical drive such as a compact disk (CD) drive or digital versatile disk (DVD) drive, a flash memory stick, etc.), and numerous other elements and functionalities. The computer processor(s) may be an integrated circuit for processing instructions. A computational device may also include one or more input device(s), such as a touchscreen, keyboard, mouse, microphone, touchpad, electronic pen, or any other type of input device. Further, a computational device may include one or more output device(s), such as a screen (e.g., a liquid crystal display (LCD), a plasma display, touchscreen, cathode ray tube (CRT) monitor, projector, or other display device), a printer, external storage, or any other output device, where one or more of the output device(s) may be the same or different from the input device(s). Computational devices may be connected to a network (e.g., a local area network (LAN), a wide area network (WAN) such as the Internet, mobile network, or any other type of network) via a network interface connection. The input and output device(s) may be locally or remotely connected to the computer processor(s), memory, and storage device(s). Further, one or more elements of a computational device may be located at a remote location and connected to the other elements over a network. Many different types of computational devices exist, and the aforementioned input and output device(s) may take other forms.

Software instructions in the form of computer readable program code to perform embodiments of the technology may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that when executed by a processor(s), is configured to perform embodiments of the technology.

Referring still to FIG. 5, the system may further include a downhole information system 150 in communication with the computational device 140, where the downhole information system 150 may provide information about the drilling operation to the computational device. For example, the downhole information system 150 may include a plurality of measurement devices disposed along a downhole drilling assembly and a processor in communication with the plurality of measurement devices, where the measurement devices send signals to and are processed by the processor to provide measurement data for the downhole drilling assembly. In some embodiments, measurement data may include drilling operating parameters, such as speed of the drill string and pumping rate of fluid being pumped downhole, wellbore parameters, and bottom hole assembly (BHA) parameters. Various parameters of a drilling operation that may be collected and/or analyzed by a downhole information system are discussed below.

"Drilling performance" may be measured by one or more drilling performance parameters. Examples of drilling performance parameters include rate of penetration (ROP), rotary torque to turn the drilling tool assembly, rotary speed at which the drilling tool assembly is turned, drilling tool assembly lateral, axial, or torsional vibrations and accelerations induced during drilling, WOB, weight on reamer (WOR), forces acting on components of the drilling tool assembly, and forces acting on the drill bit and components of the drill bit (e.g., on blades and/or cutting elements). Drilling performance parameters may also include the torque along the drilling tool assembly, bending moment, alternative stress, percentage of fatigue life consumed, pump pressure, stick slip, dog leg severity, borehole diameter, deformation, work rate, azimuth and inclination of the well, build up rate, walk rate, and bit geometry. One skilled in the art will appreciate that other drilling performance parameters exist and may be considered without departing from the scope of the disclosure.

"Wellbore parameters" may include one or more of the following: the geometry of a wellbore and formation material properties (i.e. geologic characteristics). The trajectory of a wellbore in which the drilling tool assembly is to be confined also is defined along with an initial wellbore bottom surface geometry. Because the wellbore trajectory may be straight, curved, or a combination of straight and curved sections, wellbore trajectories, in general, may be defined by defining parameters for each segment of the trajectory. For example, a wellbore may be defined as comprising N segments characterized by the length, diameter, inclination angle, and azimuth direction of each segment and an indication of the order of the segments (i.e., first, second, etc.).

Wellbore parameters defined in this manner can then be used to mathematically produce a model of the entire wellbore trajectory. Formation material properties at various depths along the wellbore may also be defined and used. One of ordinary skill in the art will appreciate that wellbore parameters may include additional properties, such as friction of the walls of the wellbore, casing and cement properties, and wellbore fluid properties, among others, without departing from the scope of the disclosure.

"BHA parameters" may include one or more of the following: the type, location, and number of components included in the drilling tool assembly; the length, internal diameter of components, outer diameter of components, weight, and material properties of each component; the type, size, weight, configuration, and material properties of the drilling tool; and the type, size, number, location, orientation, and material properties of the cutting elements on the drilling tool. Material properties in designing a drilling tool assembly may include, for example, the strength, elasticity, and density of the material. It should be understood that drilling tool assembly design parameters may include any other configuration or material property of the drilling tool assembly without departing from the scope of the disclosure.

"Bit parameters," which are a subset of BHA parameters, may include one or more of the following: bit type, size of bit, shape of bit, cutting structures on the bit, such as cutting type, cutting element geometry, number of cutting structures, and location of cutting structures. As with other components in the drilling tool assembly, the material properties of the bit may be defined.

"Drilling operating parameters" may include one or more of the following: the rotary table (or top drive mechanism), speed at which the drilling tool assembly is rotated (RPM), the downhole motor speed (if a downhole motor is included) and the hook load. Drilling operating parameters may further include drilling fluid parameters, such as the viscosity and density of the drilling fluid and pump pressure, for example. It should be understood that drilling operating parameters are not limited to these variables. In other embodiments, drilling operating parameters may include other variables, e.g., rotary torque and drilling fluid flow rate. Dip angle is the magnitude of the inclination of the formation from horizontal. Strike angle is the azimuth of the intersection of a plane with a horizontal surface. Additionally, drilling operating parameters for the purpose of drilling simulation may further include the total number of drill bit revolutions to be simulated, the total distance to be drilled, or the total drilling time desired for drilling simulation.

The parameters collected and/or analyzed by the downhole information system 150 may be shared with the computational device 140, which may provide a more robust modeling of the RCD assembly 112, a more accurate prediction model of the RCD assembly 112, and/or may help with designing an RCD assembly.

FIG. 6 shows another example of a drilling system according to embodiments of the present disclosure. The drilling system 600 includes a drilling rig 602 that is used to support drilling operations. Many of the components used on a rig 602, such as the kelly, power tongs, slips, draw works, and other equipment are not shown for ease of depiction. The rig 602 is used to support drilling and exploration operations in formation 604. The borehole 606 is shown as being partially drilled, with the casing 608 set and cemented 609 into place. In one embodiment, a casing shutoff mechanism, or downhole deployment valve 610, is installed in the casing 608 to optionally shutoff the annulus and effectively act as a valve to shut off the open hole section when the bit is located above the valve.

The drill string 612 supports a BHA 613 that includes a drill bit 620, a mud motor, a MWD/LWD sensor suite 619, including a pressure transducer 616 to determine the annular pressure, a check valve, to prevent backflow of fluid from the annulus. It also includes a telemetry package 622 that is used to transmit pressure, MWD/LWD as well as drilling information to be received at the surface. A BHA may utilize telemetry systems, such as radio frequency (RF), electromagnetic (EM) or drilling string transmission systems.

As noted above, the drilling process requires the use of a drilling fluid 650, which may be stored in a reservoir 636. A reservoir 636 may be a mud tank, pit, or any type of container that can accommodate a drilling fluid. The reservoir 636 is in fluid communication with one or more mud pumps 638 which pump the drilling fluid 650 through conduit 640. An optional flow meter 652 can be provided in series with the one or more mud pumps, either upstream or downstream thereof. The conduit 640 is connected to the last joint of the drill string 612 that passes through an RCD assembly 642. The RCD assembly 642 isolates the pressure in the annulus while still permitting drill string rotation. The fluid 650 is pumped down through the drill string 612 and the BHA 613 and exits the drill bit 620, where it circulates the cuttings away from the bit 620 and returns them up the open hole annulus 615 and then the annulus formed between the casing 608 and the drill string 612. The fluid 650 returns to the surface and goes through diverter 617 located in the RCD assembly 642, through conduit 624 to an assisted well control system 660 and various solids control equipment 629, such as, for example, a shaker. The assisted well control system 660 will be described in greater detail below.

The RCD assembly 642 may be mounted directly or indirectly on top of the wellhead or a blowout preventer (BOP) stack. The BOP stack may include an annular sealing element (annular BOP) and one or more sets of rams which may be operated to sealingly engage a pipe string disposed in the wellbore through the BOP or to cut the pipe string and seal the wellbore in the event of an emergency.

In conduit 624, a second flow meter 626 may be provided. The flow meter 626 may be a mass-balance type or other high-resolution flow meter. It will be appreciated that by monitoring flow meters 626, 652 and the volume pumped by a backpressure pump 628, the system may be able to determine the amount of fluid 650 being lost to the formation, or conversely, the amount of formation fluid leaking to the borehole 606. Based on differences in the amount of fluid 650 pumped versus fluid 650 returned, the operator may be able to determine whether fluid 650 is being lost to the formation 604, which may indicate that formation fracturing has occurred, i.e., a significant negative fluid differential. Likewise, a significant positive differential would be indicative of formation fluid entering into the wellbore.

After being treated by the solids control equipment 629, the drilling fluid is directed to mud tank 636. Drilling fluid from the mud tank 636 is directed through conduit 634 back to conduit 640 and to the drill string 612. A backpressure line 644, located upstream from the mud pumps 638, fluidly connects conduit 634 to what is generally referred to as a backpressure system 646. In one embodiment, a three-way valve may be placed in conduit 634, which may allow fluid from the mud tank 636 to be selectively directed to the rig pump 638 to enter the drill string 612 or directed to the backpressure system 646. In another embodiment, a three-way valve may be a controllable variable valve, allowing a variable partition of the total pump output to be delivered to the drill string 612 on the one side and to backpressure line 644 on the other side. This way, the drilling fluid can be pumped both into the drill string 612 and the backpressure system 646. In one embodiment, a three-way fluid junction may be provided in conduit 634, and a first variable flow restricting device may be provided between the three way fluid junction and the conduit 640 to the rig pump 638, and a second variable flow restricting device may be provided between the three way fluid junction and the backpressure line 644. Thus, the ability to provide adjustable backpressure during the entire drilling and completing processes may be provided.

The backpressure pump 628 may be provided with fluid from the reservoir through conduit 634, which is in fluid communication with the reservoir 636. While fluid from conduit 625, located downstream from the assisted well control system 660 and upstream from solids control equipment 629 could be used to supply the backpressure system 646 with fluid, it will be appreciated that fluid from reservoir 636 has been treated by solids control equipment 629. As such, the wear on backpressure pump 628 is less than the wear of pumping fluid in which drilling solids are still present.

In one embodiment, the backpressure pump 628 is capable of providing up to approximately 2200 psi (15168.5 kPa) of backpressure; though higher pressure capability pumps may be selected. The backpressure pump 628 pumps fluid into conduit 644, which is in fluid communication with conduit 624 upstream of the assisted well control system 660. As previously discussed, fluid from the annulus 615 is directed through conduit 624. Thus, the fluid from backpressure pump 628 affects a backpressure on the fluid in conduit 624 and back into the annulus 615 of the borehole. The assisted well control system 660 may include an automatic choke 662 to controllably bleed off pressurized fluid from the annulus 615 or may use a fixed position choke.

Downhole information system 220 includes a computational device in communication with one or more sensors and/or equipment units of the drilling system 600. For example, the downhole information system 220 may be in communication with one or more sensors disposed along the BHA 613, one or more sensors disposed along the drill string 612 (such as pressure and temperature sensors), one or more sensors or control devices of the assisted well control system 660, and one or more sensors or control devices of the backpressure system 646. The downhole information system 220 may collect and analyze data about the drilling system, including but not limited to drilling operating parameters, wellbore parameters, and bottom hole assembly (BHA) parameters. The downhole information system 220 may be in communication with a computational device 210 used for analyzing, monitoring, and/or designing an RCD assembly according to embodiments of the present disclosure, where the downhole information system 220 may provide information about the drilling operation to the computational device 210. In the embodiment shown in FIG. 6, the downhole information system 220 uses a computational device separate from but in communication with computational device 210. However, in some embodiments, a single computational device may be used both for a downhole information system and for analyzing, monitoring, and/or designing an RCD assembly according to embodiments of the present disclosure.

A plurality of sensors, such as described in FIGS. 1-4, is disposed along one or more components of the RCD assembly 642 and is in communication with a programmable logic controller 200. The sensors may send signals wirelessly to the programmable logic controller 200 (e.g., by sending signals to a receiver within the programmable logic controller) or may be wired to the programmable logic controller 200. The programmable logic controller 200 may process the signals received from the sensors and provide measurement data to the computational device 210 having modeling software thereon. Using the measurement data, modeling software on the computational device may model, monitor, and/or analyze performance of one or more components of the RCD 642.

Further, according to some embodiments of the present disclosure, a drilling system may include a data store for storing data related to an RCD assembly and at least one of the wellbore parameters, drilling performance, BHA parameters, and drilling operating parameters collected from the drilling operation. For example, a data store may store downhole data processed by a processor in a downhole information system. Downhole data may be collected from measurement devices disposed throughout a current drilling operation and processed by the processor of a downhole information system, and/or historical downhole data collected from remote and/or historical drilling operations may be collected and processed in the downhole information system. As used herein, the term historical downhole data may refer to downhole data collected from drilling operations occurring before a current drilling operation, from previously acquired downhole data collected and stored from a current drilling operation, from simulations of drilling operations, and/or from drilling operations conducted previous to or concurrently with but remote from a current drilling operation.

According to some embodiments, measurement data provided by a programmable logic controller from signals received from sensors along an RCD assembly may be stored in a data store. The data store may be in communication with a computational device, where the data store may be either located remotely from the computational device or located on the computational device. For example, the data store may be a storage unit or device, e.g., a file, file system, database, a hard disk, an optical drive such as a compact disk (CD) drive or digital versatile disk (DVD) drive, a flash memory stick, or other system for storing data, located on a computational device, or the data store may be located remotely from a computational device. According to some embodiments, a data store may also hold historical measurement data collected from at least one remote RCD assembly, a simulation or model of an RCD assembly, a historical RCD assembly (i.e., an RCD assembly used in a drilling operation conducted before a current drilling operation), or other RCD assembly not being used in a current drilling operation. A data store may hold historical measurement data collected from at least one RCD assembly, which may be used to design a current RCD assembly.

Measurement data collected from sensors along an RCD assembly may be used to monitor operation of the RCD assembly during a current drilling operation. For example, according to embodiments of the present disclosure, a method for monitoring equipment in a current drilling operation may include receiving a plurality of signals from a plurality of sensors provided on at least one component of an RCD assembly into a programmable logic controller, providing measurement data from the plurality of signals using the programmable logic controller, and processing the measurement data using a modeling software to determine at least one condition of the RCD assembly. As discussed above, components of an RCD assembly on which sensors may be disposed may include, for example, one or more housings, one or more sealing components, one or more latches, and a bearing package. Conditions of the RCD assembly determined from the measurement data may include, for example, a health condition of one or more components of the RCD assembly or a status of one or more defined parameters of the RCD assembly. For example, a condition may include but is not limited to fatigue, cracking, galling of the sealing components of an RCD assembly which seal around the drill string, failure of a seal, such as between a sealing assembly and bearing package or between the bearing package and the RCD housing, slip (i.e., relative rotation between the drill string and seal of the RCD assembly, temperatures and/or pressures out of preferred operation window, and excessive vibration.

Modeling software may include, for example, Finite Element Analysis (FEA) software, Integrated Design and Engineering Analysis Software (IDEAS), or other software capable of processing measurement data, such as pressure, temperature, frequency, and position to analyze health conditions of a system and/or provide actionable advice given different operating conditions. For example, in some embodiments, modeling software may include a plurality of design parameters of a current RCD assembly inputted (e.g., size, shape and material properties of the components of the RCD assembly). The modeling software may provide a model of the current RCD assembly based on the inputted design parameters and/or use the inputted design parameters during analysis of the measurement data. For example, a modeling software may be used to model a current RCD assembly or component thereof (based on inputted design parameters) and the effect of selected measurement data on the current RCD assembly or component thereof (e.g., model a measured temperature and/or pressure effect on one or more sealing elements of a current RCD assembly, such as a sealing component or one or more seals disposed within the bearing package).

According to some embodiments, measurement data may be monitored to determine if there are any changes in one or more conditions of the RCD assembly. For example, in some embodiments, at least one pressure sensor may be positioned between two sealing components of a current RCD assembly. A change in the pressure measured between the two sealing components may indicate a negative health condition (such as failure, cracking or fatigue) of one or both of the sealing components or may indicate a change in the condition of one or more different components of drilling system. Comparing changes in measurement data collected from a current RCD assembly with one or more parameters of the drilling operation may be used to determine whether the change in measurement data resulted from a change in one or more conditions of the RCD assembly or if the change in measurement data resulted from one or more parameters of the drilling operation. For example, a large change in measured pressure from measurement data collected from the RCD assembly may have resulted from a change in the fluid flow rate of the drilling system or may have resulted from a change in condition of one or more components in the RCD assembly.

In some embodiments, measurement data may be compared with limits of the inputted design parameters for one or more of the RCD assembly components. For example, in some embodiments, design parameters related to one or more sealing components or seals may be inputted into the modeling software, which may be used to provide one or more pressure and/or temperature limits (e.g., a maximum pressure and/or temperature that a sealing element may be exposed to before failure or degradation of properties). Pressure and/or temperature measurement data may be monitored and analyzed by the modeling software to determine if pressure and/or temperature conditions fall outside of the limits for one or more sealing elements.

Further, according to some embodiments, one or more drilling parameters of the current drilling operation may be inputted into the modeling software. For example, wellbore parameters, drilling performance parameters, BHA parameters, and drilling operating parameters collected from the current drilling operation, such as by using a downhole information system, as described above, may be inputted into the modeling software. Drilling parameters may be useful in analyzing and monitoring performance of an RCD assembly used in the current drilling operation. For example, pressure measurement data collected from a current RCD assembly (e.g., pressure within a bearing package of the RCD assembly or pressure within the RCD assembly housing) may be compared with pressure downhole data (e.g., pressure of fluid below the RCD assembly and/or pressure diverted from the RCD assembly) to determine any changes in pressure differentials. Changes in relative pressures within components of the RCD assembly and within components of the drilling system outside the RCD assembly may indicate, for example, a seal failure, a valve failure, and/or a leak.

According to some embodiments, at least one limit on the value of measurement data being collected may be set into the programmable logic controller, such as a maximum or minimum value of the measurement data (e.g., a maximum pressure value, maximum and/or minimum temperature value, maximum displacement, maximum vibration, etc.) being collected from sensors disposed along a RCD assembly in operation. In such embodiments, an alert may be provided when measurement data is processed outside the set limit(s). For example, if measurement data related to the vibration (e.g., amplitude and/or frequency of the vibration) of the RCD assembly is processed by the programmable logic controller (e.g., in real-time) that is greater than a set maximum vibration limit, an alert may be sent by the programmable logic controller indicating such occurrence. In another example, a maximum pressure limit within a bearing package of an RCD assembly may be set, where an alert may be provided when the measurement data collected from the sensors disposed along the RCD assembly includes at least one pressure value within the bearing package that is greater than the set maximum pressure limit.

One or more different actions may be taken when an alarm is provided, or no action may be taken. For example, in some embodiments, at least one drilling parameter of the drilling operation may be altered when an alert is provided. The drilling parameter(s) being changed and the magnitude of the change in response to the alert may be selected to account for the change in condition in the RCD assembly or to bring the measurement data values being collected within the set limit(s). For example, upon receiving an alert that the pressure on the lower side of the RCD assembly is over a set maximum pressure limit, one or more drilling parameters may be altered to lower the pressure, such as by increasing the rate of fluid being diverted from the RCD assembly.

Figure 7:
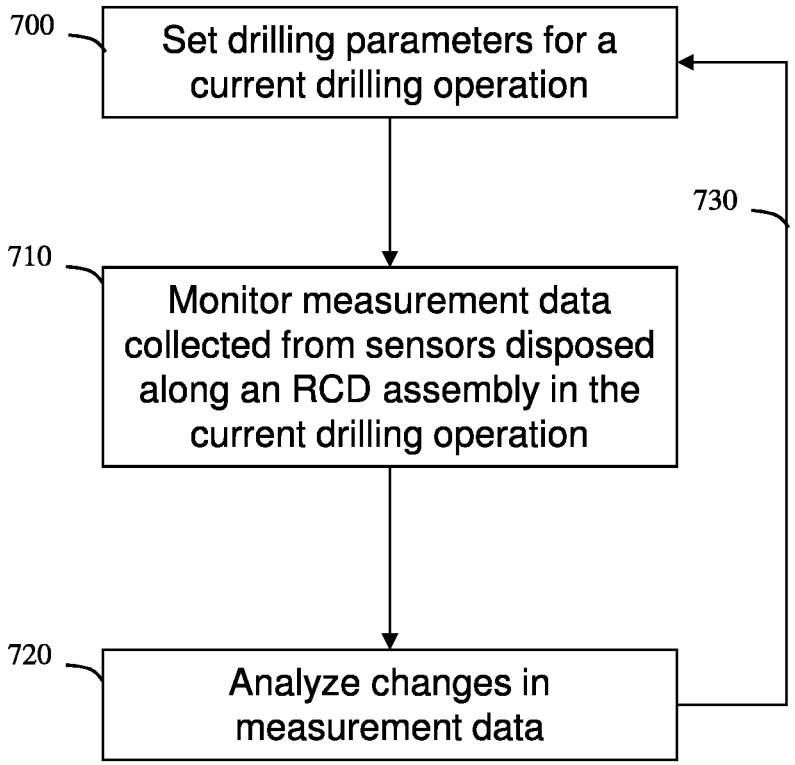
FIG. 7 shows a method according to embodiments of the present disclosure.

FIG. 7 shows an example of a method according to embodiments of the present disclosure. As shown, one or more drilling parameters for a current drilling operation may be set 700, which may include, for example, wellbore parameters, BHA parameters, drilling operating parameters, and drilling performance parameters. For example, a drilling operator may set one or more of the drilling parameters, one or more drilling parameters may be set during design and manufacture of the drilling system, and one or more of the drilling parameters may be set automatically using an optimization program. Measurement data collected from sensors disposed along an RCD assembly in the current drilling operation may be monitored 710 according to methods disclosed herein. Changes in the measurement data may be analyzed 720 to determine the conditions of one or more components of the RCD assembly and/or to compare with other parameters of the current drilling system. In some embodiments, one or more parameters of the current drilling operation may be altered 730 in response to the change in measurement data collected from the sensors of the RCD assembly. For example, parameters of the drilling operation that may be altered in response to changes in measurement data collected from the RCD assembly may include but are not limited to altering the fluid flow rate of the fluid being pumped through the drill string, altering operation of one or more valves and/or pumps affecting the flow of fluid being diverted from the annulus (e.g., in response to increases in pressure measured from the RCD assembly), and/or altering the RPM of the drilling tool assembly (e.g., in response to increases in amount of vibration measured from the RCD assembly).

In one example according to embodiments of the present disclosure, the position of a drill string relative to a sealing component in a current RCD assembly may be measured using at least one position sensor. The position sensor(s) may send signals to a programmable logic controller, which may process the signals and send measurement data related to the position of the drill string relative to the sealing component to a computational device having modeling software. In another example according to embodiments of the present disclosure, at least one frequency sensor may be positioned on at least one of a sealing component and/or a bearing package of a current RCD assembly and a drill string. The frequency sensor(s) sends signals to a programmable logic controller, which may process the signals and send measurement data related to the rotational speed of the sealing component, bearing package and/or drill string to a computational device having modeling software. Modeling software may be used to analyze collected position measurement data and/or collected frequency measurement data, for example, to determine differences in movement between the monitored components or if slip is occurring between the drill string and sealing component. For example, frequency sensors may be disposed on a bearing package or sealing component and on a drill string extending through the RCD assembly to measure the rotational speed of each, where a difference in rotational speed between the sealing component or bearing package and the drill string may indicate slip.

According to some embodiments, measurement data collected from sensors along an RCD assembly in a current drilling operation may be used to predict performance of one or more elements of the RCD assembly. For example, measurement data related to a bearing package of an RCD assembly (e.g., pressure measured inside of the bearing package) may be used to predict failure of a sealing component of the RCD assembly. In some embodiments, measurement data collected from sensors of a current RCD assembly may be compared with historical measurement data from RCD assemblies having one or more similar design parameters and/or RCD assemblies that have operated in similar environments. For example, historical measurement data from an RCD assembly that failed due to determined temperature and pressure conditions may be used to predict when a current RCD assembly exposed to the same or similar temperature and pressure conditions may fail.

Further, significant expense is involved in the design and manufacture of drilling and operating equipment. As such, in order to optimize performance of a drilling system, engineers may consider a variety of factors. For example, when designing a drilling system, engineers may consider a rock profile (e.g., the type of rock or the geologic characteristics of an earth formation), different forces acting on the drilling system, drilling performance parameters, drill bit parameters, and/or wellbore parameters, among many others.

Methods disclosed herein may be used to design an RCD assembly. For example, according to embodiments of the present disclosure, a method for designing equipment in a current drilling operation may include obtaining previously acquired measurement data from a plurality of sensors disposed on at least one RCD assembly, where each RCD assembly operates under a plurality of drilling parameters, processing the measurement data using a modeling software to determine at least one condition of the RCD assembly(s), storing the condition(s) as being associated with the drilling parameters under which the RCD assembly operated, and selecting at least one design parameter of a current RCD assembly based on drilling parameters of the current drilling operation and the stored condition(s). Previously acquired measurement data may include historical measurement data collected from one or more RCD assemblies or may include measurement data collected from one or more current RCD assemblies (used in a current drilling system) that has been stored for later use.

Storing a determined condition as being associated with the drilling parameters under which the RCD assembly operated may include, for example, storing the related data in a searchable database. For example, a database may include a plurality of determined conditions of RCD assemblies and the parameters under which the conditions occurred, where either a condition type may be searched for or a parameter may be searched for. When a searched condition type is presented, the associated parameters under which the condition type has occurred in the past may be presented in the search results. Likewise, when a searched parameter (or combination of parameters) is presented, the associated conditions that have occurred under the parameter(s) in the past may be presented in the search results. Determined conditions may include but are not limited to lifetimes of one or more components of the RCD assembly, failure types of one or more components of the RCD assembly, measurement data values such as amount of displacement and amount of vibration, drill string slip, and yes/no logic-type information, such as whether the bearing package is rotating as designed, whether a latch is in the latched position, whether a pressure is being maintained between seals, and others.

According to embodiments of the present disclosure, an RCD assembly may be designed for a current drilling operation (e.g., as a replacement RCD assembly or to repair a current RCD assembly). For example, a method for designing an RCD assembly may include selecting stored drilling parameters having a plurality of shared values with the drilling parameters of the current drilling operation, such as from a database or other data store type. At least one optimized condition associated with the selected stored drilling parameters may be determined. For example, as discussed above, conditions associated with drilling parameters may be stored in a searchable database, where either one or a combination of drilling parameters or a condition may be searched, and the associated conditions or parameters may be presented in the search results. From the search results, a user may select an optimized result, or a software program may automatically select an optimized result, for example. At least one design parameter of a current RCD assembly may then be selected based on the design parameters of the RCD assembly having the optimized condition.

For example, to design an RCD assembly that may be capable of functioning under a first and second drilling parameter of a current drilling operation (e.g., under a certain pressure from the fluid in the annular space below the RCD assembly, with a certain drill string rpm, or other drilling parameters), stored data for drilling systems having the first and second drilling parameters may be searched. According to other embodiments, one or more than two drilling parameters may be selected when designing an RCD assembly. The results of the search may include one or more conditions of the RCD assemblies used in the drilling systems having the first and second drilling parameters, from which one or more optimally performing RCD assemblies (performing under the first and second drilling parameters) may be determined. One or more design parameters of the optimally performing RCD assemblies may then be used to design the current RCD assembly (or to repair and/or replace one or more components of a current RCD assembly).

Upon selecting one or more design parameters of an RCD assembly, the RCD assembly may be designed and its performance may be predicted. For example, in some embodiments, the modeling software may model the designed RCD assembly, and the modeled RCD assembly may be simulated in selected drilling systems (where the drilling system may be defined in the simulation by wellbore parameters, drilling operation parameters, BHA parameters, etc.) to predict the performance of the designed RCD assembly. In some embodiments, performance of previously used RCD assemblies having the same or similar design parameters as those of the designed RCD assembly and operated under the same or similar drilling conditions may be analyzed to predict performance of the designed RCD assembly.

According to some embodiments of the present disclosure, at least one condition of a current RCD assembly may be predicted operating under one or more altered drilling parameters. Predicting conditions of an RCD assembly under altered drilling parameters may include selecting stored drilling parameters having shared values with the altered drilling parameters and determining the conditions associated with the selected stored drilling parameters. For example, downhole data stored in a data store may be searched for drilling systems having the altered drilling parameters and RCD assemblies with the same or similar design parameters of the current RCD assembly, where the prediction of the current RCD assembly conditions may be based on the stored conditions of the RCD assemblies in the drilling systems having the altered drilling parameters. In other embodiments, predicting conditions of an RCD assembly under altered drilling parameters may include simulating the RCD assembly under the altered drilling parameters using modeling and/or simulation software.

Prediction of RCD assembly performance under altered drilling parameters may be useful in situations when the drilling system changes, such as when a new type of formation is encountered and one or more drilling operation parameters are changed to drill through the new formation type, during directional drilling, when one or more components of the drilling system fails, during heaves in offshore drilling, and others.

While the claimed subject matter has been described with respect to a limited number of embodiments, those skilled in the art, having the benefit of this disclosure, will appreciate that other embodiments can be devised which do not depart from the scope of the claimed subject matter as disclosed herein. Accordingly, the scope of the claimed subject matter should be limited only by the attached claims.

What is claimed is:

1. A method comprising:

receiving a plurality of signals from a plurality of sensors into a programmable logic controller, the plurality of sensors provided on at least one component of a rotating control device assembly of a drilling system;

providing measurement data from the plurality of signals using the programmable logic controller;

processing the measurement data using a modeling software to determine at least one condition of the rotating control device assembly; and setting at least one limit into the programmable logic controller, where an alert is provided when measurement data is processed outside the at least one limit, wherein the at least one limit comprises a maximum pressure within a bearing package of the rotating control device assembly, and wherein the alert is provided when the measurement data comprises at least one pressure value within the bearing package that is greater than the maximum pressure.

2. The method of claim 1, further comprising inputting a plurality of drilling parameters of a drilling operation into the modeling software.

3. The method of claim 1, wherein the at least one component includes the bearing package of the rotating control device assembly.

4. The method of claim 1, wherein the plurality of sensors comprise pressure sensors.

5. The method of claim 1, further comprising altering at least one drilling parameter of the drilling operation when the alert is provided.

6. The method of claim 1, further comprising measuring a position of a drill string relative to a sealing component in the rotating control device assembly using at least one position sensor, wherein the at least one position sensor sends signals to the programmable logic controller, and the measurement data comprises the position of the drill string relative to the sealing component.

7. The method of claim 1, wherein the plurality of sensors includes a pressure sensor positioned between two sealing components of the rotating control device assembly.

8. The method of claim 1, wherein the plurality of sensors includes at least one frequency sensor positioned on at least one of a sealing component and the bearing package of the rotating control device assembly, wherein the at least one frequency sensor sends signals to the programmable logic controller, and the measurement data comprises the rotational speed of the at least one of the sealing component and the bearing package of the rotating control device assembly.

9. A method comprising:

measuring a position of a drill string relative to a sealing component in a rotating control device assembly using at least one position sensor;

receiving a plurality of signals from a plurality of sensors including the at least one position sensor into a programmable logic controller, the plurality of sensors provided on at least one component of the rotating control device assembly of a drilling system;

providing measurement data from the plurality of signals using the programmable logic controller, wherein the measurement data comprises the position of the drill string relative to the sealing component; and processing the measurement data using a modeling software to determine at least one condition of the rotating control device assembly.

10. The method of claim 9, further comprising inputting a plurality of drilling parameters of a drilling operation into the modeling software.

11. The method of claim 9, wherein the at least one component is selected from the group consisting of a housing, a sealing component, a latch and a bearing package of the rotating control device assembly.

12. The method of claim 9, further comprising:

setting at least one limit into the programmable logic controller, where an alert is provided when measurement data is processed outside the at least one limit.

13. The method of claim 12, further comprising altering at least one drilling parameter of the drilling operation when the alert is provided.

14. The method of claim 9, wherein the plurality of sensors includes a pressure sensor positioned between two sealing components of the rotating control device assembly.

15. The method of claim 9, wherein the plurality of sensors includes at least one frequency sensor positioned on at least one of a sealing component and a bearing package of the rotating control device assembly, wherein the at least one frequency sensor sends signals to the programmable logic controller, and the measurement data comprises the rotational speed of the at least one of the sealing component and the bearing package of the rotating control device assembly.

16. A method comprising:

receiving a plurality of signals from a plurality of sensors into a programmable logic controller, the plurality of sensors provided on at least one component of a rotating control device assembly of a drilling system;

providing measurement data from the plurality of signals using the programmable logic controller; and processing the measurement data using a modeling software to determine at least one condition of the rotating control device assembly, wherein the plurality of sensors includes at least one frequency sensor positioned on at least one of a sealing component and a bearing package of the rotating control device assembly, wherein the at least one frequency sensor sends signals to the programmable logic controller, and wherein the measurement data comprises the rotational speed of the at least one of the sealing component and the bearing package of the rotating control device assembly.

17. The method of claim 16, further comprising inputting a plurality of drilling parameters of a drilling operation into the modeling software.

18. The method of claim 16, further comprising:

setting at least one limit into the programmable logic controller, where an alert is provided when measurement data is processed outside the at least one limit.

19. The method of claim 18, further comprising altering at least one drilling parameter of the drilling operation when the alert is provided.

20. The method of claim 16, wherein the plurality of sensors includes a pressure sensor positioned between two sealing components of the rotating control device assembly.

* * * * *